United States Patent [19]

Voegele

[11] 3,991,809

[45] Nov. 16, 1976

[54] METHOD OF MOLDING FINGER RINGS

[75] Inventor: Lawrence R. Voegele, Owatonna, Minn.

[73] Assignee: Josten's, Inc., Owatonna, Minn.

[22] Filed: Mar. 10, 1975

[21] Appl. No.: 557,020

[52] U.S. Cl. ..... 164/35; 164/45

[51] Int. Cl.[2] ..... B22C 7/02; B22C 9/04

[58] Field of Search ..... 164/34, 35, 45, 235, 164/245, 376, 246, 249; 249/57

[56] References Cited

UNITED STATES PATENTS

| | | | |
|---|---|---|---|
| 1,389,315 | 8/1921 | Moats | 164/235 |
| 2,790,220 | 4/1957 | Fox | 164/35 |
| 3,424,227 | 1/1969 | Watts et al. | 164/34 X |
| 3,838,728 | 10/1974 | Voegele | 164/45 |

*Primary Examiner*—Francis S. Husar
*Assistant Examiner*—John E. Roethel
*Attorney, Agent, or Firm*—Dorsey, Windhorst, Hannaford, Whitney & Halladay

[57] ABSTRACT

A method of molding finger rings of the type having a hollowed-out interior portion, but whose exterior surfaces are identical to rings without such hollowed-out portion comprising securing a wax, shell ring pattern to the exterior surface of a wax, tubular section to form a wax ring pattern and molding a finger ring from said wax ring pattern via an investment method of casting.

14 Claims, 11 Drawing Figures

METHOD OF MOLDING FINGER RINGS

BACKGROUND OF THE INVENTION

The present invention relates generally to a method of molding finger rings, and, more particularly, to a method of molding finger rings having a hollowed-out interior portion, but whose exterior surface is identical to rings without such a hollowed-out portion and which are visually identical to such rings. The present invention also relates to a method of making the ring pattern for use in the molding of such finger rings.

Normally, scholastic rings such as those purchased by students as graduation and class rings are molded from a relatively precious metal such as gold or silver. Such rings are molded throughout from this precious metal including the entire interior portion of the ring between the exterior surface thereof and the cylindrical bore which contacts, and slides over, the finger of the wearer. These rings are relatively expensive due, in part, to the relatively large amount of precious metal which is used. Further, such rings are quite heavy. Consequently, it is desirable to eliminate a nonfunctional interior portion of the metal ring in order to reduce the cost and the weight thereof. One prior attempt along these lines was to eliminate or hollow-out a portion of the ring existing between the finger of the wearer and the exterior surface of the ring. An example of this type of ring and the method of molding such ring is described and illustrated in U.S. Pat. No. 3,838,728. Although this particular prior ring structure had several advantages over the prior art in that it was lighter and required less material, it had several disadvantages. First, such ring had the appearance of being an inexpensive, low quality ring because of the fact that a substantial portion of the interior was hollowed out. Secondly, such a ring caused discomfort to many wearers because of the relatively sharp edge on the ring and the absence of the cylindrical bore extending through the ring which is normally in contact with the finger of the wearer. Consequently, there are real advantages of and needs for a method of molding a finger ring in which part of the nonfunctional portion of such ring is eliminated, thereby reducing the weight and cost of such ring, while, at the same time, providing a ring which is visually acceptable and comfortable to the wearer.

SUMMARY OF THE INVENTION

In contrast to the prior art, the present invention relates to a method of molding a finger ring having a hollowed-out interior portion, but which is visually identical to a solid ring without such hollowed-out portion. Such a ring includes all of the advantages of the ring with the hollowed-out portion illustrated in U.S. Pat. No. 3,838,728 but none of the disadvantages. Generally, the method of the present invention includes first forming a tubular section of a wax material conventionally used in an investment method of casting, supporting such tubular section on a sizing means and securing a wax, shell ring pattern to the exterior surface of such tubular section. When this is accomplished, a wax ring pattern of the desired end product is obtained which can be used in an investment method of casting to mold the ring. Such ring pattern includes a hollowed-out section on the interior portion of the ring, but one which also includes a cylindrical bore formed by the tubular section. The appearance of the exterior of such ring pattern is identical to that of the desired end product.

Specifically, the method of the present invention includes splitting a wax, tubular section, mounting the tubular section on a sizing means such as a sizing mandrel and securing a wax, shell ring pattern to the exterior surface of the tubular section. Following the joining of the shell ring pattern to the tubular section, the portions of the tubular section and the shell ring pattern which were split prior to placement on the sizing mandrel are joined or welded together with a suitable wax material of the type normally used in an investment casting process and the excess of the tubular section on each side of the wax, shell ring pattern is trimmed, leaving a wax ring pattern identical in virtually all respects to the desired ring end product. This ring pattern is then used in a conventional investment casting method to mold a ring having a hollowed-out interior portion but which is visually identical, in all respects, to a solid ring having no such hollowed-out portion. It is estimated that molding a finger ring according to the method of the present invention can result in precious metal savings of up to forty percent on larger rings.

Accordingly, it is an object of the present invention to provide a method of molding a finger ring of the type having a hollowed-out interior portion.

It is a further object of the present invention to provide a method of molding a finger ring of the type having a hollowed-out interior portion, but which ring has a visual exterior appearance identical to that of a solid ring without such hollowed-out portion.

Another object of the present invention is to provide a method for molding a finger ring pattern which can be used in an investment casting process to mold a finger ring of the type having a hollowed-out interior portion which is visually identical to a ring without such hollowed out portion.

These and other objects of the present invention will become apparent with reference to the drawings, the description of the preferred method and embodiment for performing such method and the appended claims.

DESCRIPTION OF THE PREFERRED METHOD AND EMBODIMENT FOR PERFORMING SUCH METHOD

The present invention relates to a method for molding a finger ring of the type having a hollowed-out interior portion, but whose exterior surface is identical, and which ring is visually identical, to a finger ring which does not have such hollowed-out portion. The present invention also relates to a method of forming a wax pattern which can be used in an investment method of casting to mold such a ring.

Figure 1:
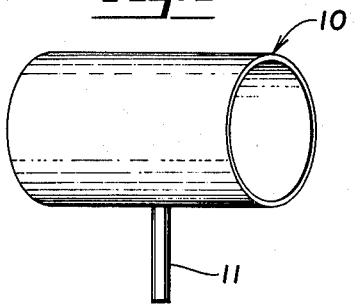
FIG. 1 is a pictorial view of the wax, tubular section which is used in the method of the present invention.
Figure 2:
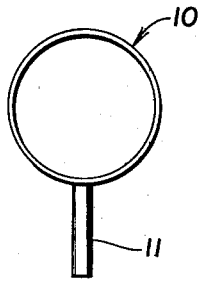
FIG. 2 is an end view of the wax, tubular section of FIG. 1.

Reference is made to the drawings which illustrate the various elements and structural members needed to carry out the method of the present invention. Specifically, FIG. 1 is a pictorial view of a wax, tubular section 10 which is one of the elements used in performing the method of the present invention. The section 10 may be formed by any conventional means; however, in the preferred method, it is formed by a molding process in which molten wax is injected into a molding cavity having the shape of the section 10. As illustrated in both FIGS. 1 and 2, the section 10 is a cylindrically shaped tubular section having a sprue 11 integrally formed with the section 10. Such sprue 11 is formed during the molding process. The tubular section 10 is an annular member of relatively resilient and flexible characteristics having an inner cylindrical surface and an outer cylindrical surface. As will be discussed below, the section 10 forms the cylindrical bore of the final wax ring pattern. The material from which the section 10 is formed is a wax material of the type conventionally used in an investment method of casting. Specifications for such a wax can be found in the prior art and other sources relating to the investment method of casting.

Figure 3:
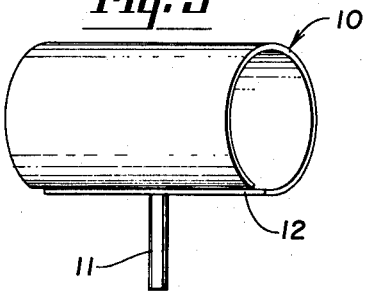
FIG. 3 is a pictorial view of the wax, tubular section used in the present invention which has been split longitudinally.
Figure 4:
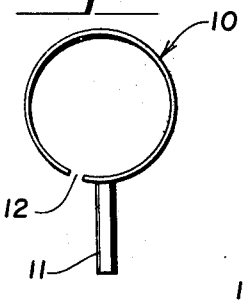
FIG. 4 is an end view of the wax, tubular section of FIG. 3.

Following the formation of the tubular section 10, such section is split longitudinally at reference numeral 12 as illustrated in FIGS. 3 and 4. The purpose of such split 12 is to facilitate the molding of a variety of sizes of rings as will hereinafter be seen. Specifically, the split 12 is made longitudinally in the section 10 adjacent to one side of the sprue 11.

Figure 5:
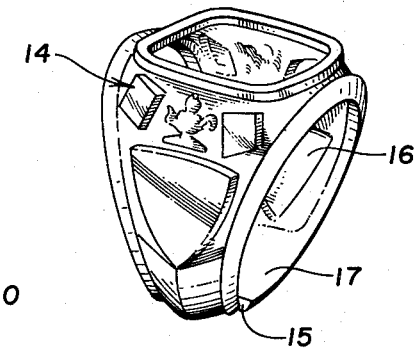
FIG. 5 is a pictorial view of the wax, shell ring pattern which is used in the method of the present invention.
Figure 6:
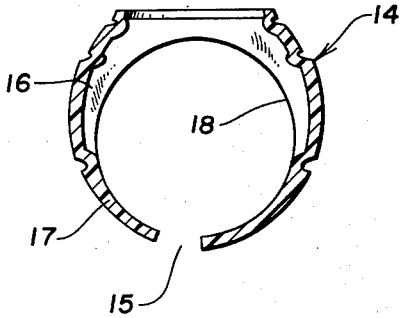
FIG. 6 is a sectional view of the wax, shell ring pattern as viewed along the line 6—6 of FIG. 5.

Next, a wax, shell ring pattern of the type illustrated in FIGS. 5 and 6 is formed. Such a shell ring pattern 14 may be formed in a variety of ways; however, in the preferred method, the pattern 14 is formed by a molding process similar to that described and illustrated in U.S. Pat. No. 3,838,728.

For the purposes of this application, the term shell ring pattern shall refer to a structure similar to that illustrated in FIG. 5 which includes all of the detail and design of the exterior surface of the final desired ring and which also has a hollowed-out interior portion as shown by the reference numeral 16. Although not necessary, it is preferrable if the hollowed-out portion 16 is such that it results in a ring of uniform thickness. The shell ring pattern 14 also includes an inner edge 18 and a band portion 17 which is split at its lower, central portion 15. It should be noted that the hollowed-out portion 16 exists only in a portion of the pattern 14 and does not extend completely throughout the band portion 17. Similar to the wax, tubular section 10 of FIGS. 1–4, the wax, shell ring pattern 14 of FIGS. 4 and 5 is formed from a wax of the type conventionally used in an investment casting process.

Following the forming of the wax, tubular section 10 and the wax, shell ring pattern 14, the wax, tubular section 10 is mounted on a sizing means, for the ultimate purpose of forming a ring pattern of a desired ring size. In the preferred method, the sizing means is a sizing mandrel 19 of the type illustrated in FIG. 7. Such mandrel includes a plurality of stepped portions or levels 20, 21 and 22 which correspond to various sizes of rings. Because the tubular section 10 is split along the line 12, and because the tubular section is relatively flexible, the section 10 can be opened or spread to fit around the sizing mandrel 19, thus corresponding to any ring size. In some cases, however, when rings of a small size are desired, it is necessary to cut an additional longitudinal section from the tubular section 10 so that the interior cylindrical surface of the section 10 will fit snugly around the sizing mandrel 19. Because of the resilient and flexible nature of the tubular section 10, the section 10 is retained on the sizing mandrel with the inner surface of the section 10 in contact with the outer surface of the mandrel 19 as a result of such resilient and flexible characteristics.

Figure 7:
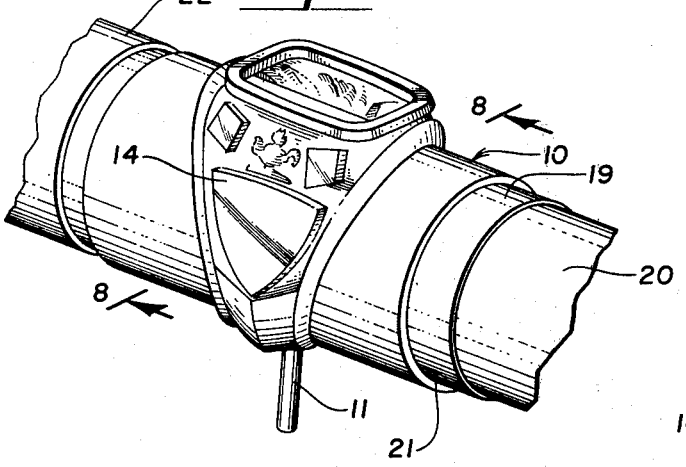
FIG. 7 is a pictorial view of the wax, tubular section and wax, shell ring pattern mounted on the sizing mandrel.

After the section 10 has been placed on the mandrel 19, the wax, shell ring pattern 14 is secured to the exterior surface of the section 10 in the position illustrated in FIG. 7. Although a variety of glues, adhesives and other bonding materials may be used to secure the shell ring pattern 14 to the tubular section 10, applicant has found that a pressure sensitive adhesive is acceptable In the preferred method, the shell ring pattern 14 is secured to the section 10 by applying a pressure sensitive adhesive to the inside edge 18 (FIG. 6) of the shell ring pattern 14 and allowing such adhesive to set for a period of time until the adhesive is tacky. The shell ring pattern 14 is then separated slightly and placed over the section 10 in the position illustrated in FIGS. 7 and 8. The shell ring pattern 14 is then released and the edge 18 and the band portions 17 are allowed to contact the exterior surface of the section 10 securing it thereto. It is also preferable, in some instances, to exert an additional pressure against the exterior surface of the pattern 14 to insure sufficient contact between the inner edge 18 (FIG. 6) and the outer surface of the section 10. In the preferred method, the inventor has found that an acceptable adhesive for this purpose is marketed under the trade name Micro Crystal and is manufactured by Alexander Landers of Cold Spring, New York. The specific adhesive which is used is not critical to the method of the present invention, providing a sufficient seal is made between the inner edge 18 (FIG. 6) and the outer surface of the section 10. As will be hereinafter described below, if such a seal is unsatisfactory, investment plaster can leak between such elements resulting in an inferior product.

Figure 8:
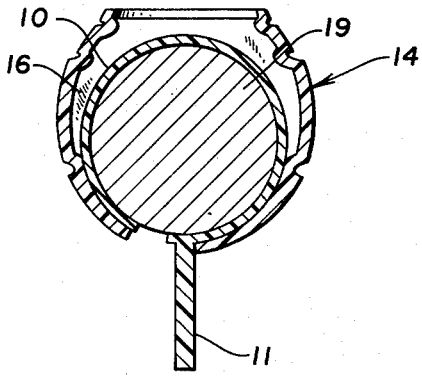
FIG. 8 is a sectional view of the sizing mandrel and the tubular section and shell ring pattern mounted thereto as viewed along the line 8—8 of FIG. 7.
Figure 9:
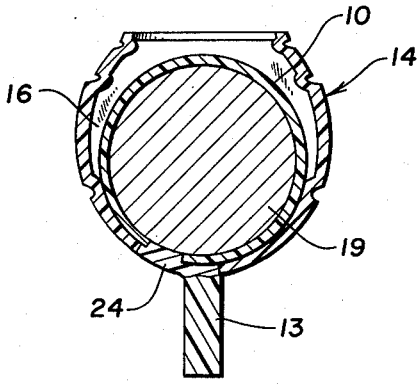
FIG. 9 is a sectional view, similar to that of FIG. 8, except that the split portions of the wax, tubular section and the wax, shell ring pattern have been joined together.

Further reference is made to FIG. 8 which is a sectional view taken along the line 8—8 of FIG. 7. As noted in FIG. 8, the split 12 in the tubular section 10 and the split 15 in the shell ring pattern 14 are in approximate alignment such that the split 15 overlaps the split 12. At this point, the tubular section 10 and shell ring pattern 14 are joined or welded together by applying an appropriate wax material to the area of the ring pattern 14 and section 10 at which the splits 12 and 15 are located. The application of such wax in this manner is illustrated in FIG. 9. The wax which is used for this purpose is a wax which is conventionally used in an investment method of casting, however, such wax must also be capable of joining or welding the section 10 and shell ring pattern 14 together as shown. At this time in the performance of the method, it is often desirable to remove the sprue 11, which is a relatively small sprue, and replace it with a larger sprue 13 (FIG. 9) which is more centrally disposed with respect to the resulting structure. Such larger sprue 13 is secured by the wax as shown in FIG. 9.

Figure 10:
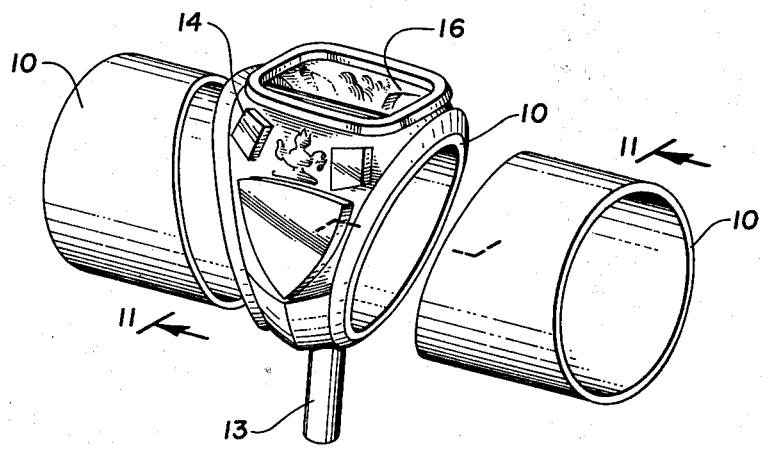
FIG. 10 is a pictorial view showing the portions of the wax, tubular section as they are trimmed from the ring pattern.
Figure 11:
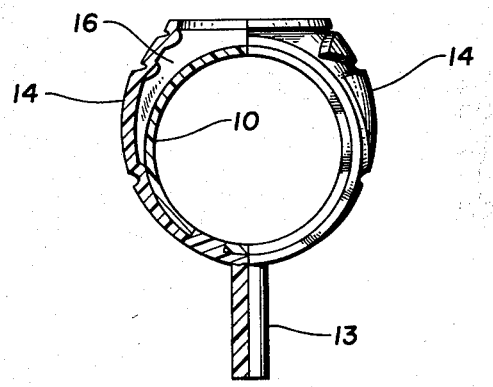
FIG. 11 is a half section of the final ring pattern as viewed along the line 11—11 of FIG. 10.

The sizing mandrel 19 is then removed from the interior of the section 10 and the excess portions of the tubular section 10 which extend from each side of the shell ring pattern 14 are trimmed as illustrated in FIG. 10. This trimming can be accomplished with any suitably sharp tool such as a knife or razor. Following the trimming step, the resulting structure constitutes a wax ring pattern which is identical in virtually all respects to the exterior surface of the desired ring product. Such structure still, of course, includes the sprue 13 which is necessary to carry out the investment casting process. As illustrated in FIG. 11, which is a half section of the ring pattern as viewed along the line 11—11 of FIG. 10, such ring pattern includes a hollowed-out portion 16. Also, as shown, the inner cylindrical surface of the tubular section 10 forms the cylindrical bore normally in contact with the finger of the wearer. However, despite the existence of the hollowed-out portion 16, the exterior surfaces of this structure, as shown in the righthand half of FIG. 11, includes all of the exterior detail of the desired ring product, including the cylindrical bore, as if such ring product were of a solid structure.

The resulting ring pattern, illustrated in FIGS. 10 and 11 is then used to mold the final finger ring by a method which is known as the "lost wax" or "investment" method of casting. To accomplish this, the ring pattern of FIGS. 10 and 11 is encased in an investment plaster material until the plaster is hardened. The wax model or pattern is then vaporized by use of extreme heat in a burnout furnace thereby leaving a pattern chamber in the plaster mold conforming to the configuration of the ring pattern. Molten metal of the type which is desired to be used in the final ring product is then introduced into the pattern chamber and allowed to solidify. When sufficient hardening has taken place, the plaster is broken away leaving the solidified ring. The resulting metal ring may then be finished by grinding off unnecessary or undesirable edges, polishing, etc. A gem or stone and basel (not shown) are then mounted to the ring in a known manner.

The method of the present invention may be summarized as follows: First, a tubular section 10 and a shell ring pattern 14 are formed. Each is formed of a wax material conventionally used in an investment method of casting. Next, both the tubular section 10 and the shell ring pattern 14 are split, as illustrated, and the tubular section 10 is then mounted on the sizing Mandrel 19. Next, adhesive is applied to the inner edges 18 of the pattern 14 and such pattern 14 is secured to the exterior of the section 10. The section 10 and pattern 14 are then joined together in the area in which such elements are split by an appropriate wax material. The excess portions of the tubular section are then trimmed from the pattern 14, thus forming a wax, ring pattern. This wax, ring pattern is then used to mold the finger ring by an investment method of casting.

Although the description of the preferred method of the ring molding method of the present invention has been quite specific, it is contemplated that various chages and modifications could be made without deviating from the spirit of the present invention. Thus, the scope of the present invention is intended to be measured by the appended claims rather than by the description of the preferred method.

I claim:

1. A method of making a wax pattern for a finger ring suitable for use in an investment method of casting comprising the steps of: securing a shell ring pattern having a hollowed-out interior portion to the exterior surface of a tubular section, each of said shell ring pattern and tubular section being composed of a wax material suitable for use in an investment method of casting and each being secured to the other such that said shell ring pattern extends substantially about the periphery of said tubular section and said hollowed-out portion is disposed between said shell ring pattern and said tubular section, thereby forming a wax ring pattern comprised of said shell ring pattern and said tubular section.

2. The method of claim 1 including forming a wax, shell ring pattern.

3. The method of claim 1 including forming a wax, tubular section.

4. The method of claim 1 including splitting said wax, tubular section longitudinally and disposing said wax, tubular section on a sizing mandrel prior to securing said wax, shell ring pattern thereto.

5. The method of claim 4 including splitting said wax, shell ring pattern near the center of its band prior to securing said wax, shell ring pattern to said wax, tubular section.

6. The method of claim 5 including securing said wax, shell ring pattern to said wax, tubular section such that the split in said wax, shell ring pattern and the split in said wax, tubular section are in approximate alignment.

7. The method of claim 6 including joining the split portions of said wax, tubular section and said wax, shell ring pattern together.

8. The method of claim 7 including joining the split portions of, said wax, tubular section and said wax, shell ring pattern with a wax material suitable for use in an investment method of casting.

9. The method of claim 8 including trimming the excess portion of said tubular section from each side of said shell ring pattern.

10. The method of claim 9 including securing said wax, shell ring pattern to said wax, tubular section with a pressure sensitive adhesive.

11. The method of claim 1 including securing sad wax, shell ring pattern to said wax, tubular section with a pressure sensitive adhesive.

12. The method of claim 1 including trimming the excess portion of said tubular section from each side of said shell ring pattern.

13. A method of molding a finger ring comprising the steps of: securing a shell ring pattern having a hollowed out interior portion to the exterior surface of a tubular section, each of said shell ring pattern and said tubular section being composed of a wax material suitable for use in an investment method of casting and each being secured to the other such that said shell ring pattern extends substantially about the periphery of said tubular section and said hollowed-out portion is disposed between said shell ring pattern and said tubular section, thereby forming a wax ring pattern comprised of said shell ring pattern and said tubular section; and molding a finger ring from said wax ring pattern via an investment method of casting including encasing said wax ring pattern in an investment plaster and replacing said wax ring pattern with a second material of which the finger ring is intended to be made.

14. The method of claim 13 wherein said step of molding a finger ring includes encasing said ring pattern in an investment plaster, eliminating said ring pattern from said investment plaster thereby forming a cavity therein, and introducing a second material of which the finger ring is intended to be made into said cavity.

* * * * *